US006098707A

United States Patent [19]

Pastusek et al.

[11] Patent Number: 6,098,707

[45] Date of Patent: Aug. 8, 2000

[54] PERFORATION GUN FOR WELL CASING

[75] Inventors: Stan Pastusek, Arlington; Larry Goin, Burleson; Tom Ricles, Joshua, all of Tex.

[73] Assignee: The Ensign-Bickford Company, Simsbury, Conn.

[21] Appl. No.: 09/065,712

[22] Filed: Apr. 24, 1998

[51] Int. Cl.[7] ..... E21B 43/117

[52] U.S. Cl. ..... 166/55.1; 175/4.6

[58] Field of Search ..... 175/4.6; 166/55.1

[56] References Cited

U.S. PATENT DOCUMENTS

| | | | |
|---|---|---|---|
| 3,235,005 | 2/1966 | Delacour | 175/4.6 |
| 3,282,354 | 11/1966 | Hakala et al. | 166/55.1 |
| 3,327,630 | 6/1967 | Bell | 175/4.57 |
| 3,991,836 | 11/1976 | Bouguyon et al. | 175/4.6 |
| 4,496,008 | 1/1985 | Pottier et al. | 175/4.6 |
| 4,832,134 | 5/1989 | Gill | 175/4.6 |
| 4,951,744 | 8/1990 | Rytlewski | 175/4.6 |
| 5,638,901 | 6/1997 | Shirley et al. | 166/55.1 |

*Primary Examiner*—George Suchfield

*Attorney, Agent, or Firm*—Libert & Associates; Victor E. Libert; Craig W. Barber

[57] ABSTRACT

A perforating gun for perforating a section of a well casing in which a plurality of explosive charge units are mounted on an elongated mounting strip in a pattern corresponding to the desired pattern of perforations in the well casing. The areas of the mounting strip that receive the charge units have a greater width than the remaining areas of the strip to provide an increased support surface for the charge units. Each charge unit is formed by a case connected to a cap to provide a housing for the explosive. The cap is crimped to the case to prevent premature detonation of the explosive.

6 Claims, 2 Drawing Sheets

PERFORATION GUN FOR WELL CASING

BACKGROUND OF THE INVENTION

The present invention relates to a gun for perforating a well casing and, more particularly, to a gun for supporting and detonating explosive charges in a well casing to form perforations in the casing through which water, petroleum or minerals can flow.

Perforating guns of the above type are well known and generally include a plurality of capsule charges mounted to a mounting plate, or strip, by a plurality of clips, or the like. However, these arrangements suffer from several disadvantages. For example, the mounting strip for supporting the charges is usually relatively brittle so that it will fracture into many small pieces when the charges are detonated. In addition to forming debris in the well after the explosions, the strip often breaks when it is introduced into the well. Also, the mounting strip has a relatively narrow width (in a developed view) to form a sufficient clearance between it and the inner surface of the casing. As a result, the support surface for the caps of the charge units is limited and, as a result, the caps are often separated from the mounting strip during the explosions and thus add to the debris. Further, the case of the charge unit is often connected to the cap in a manner, such as by providing cooperating threads on each, that does not secure the case to the cap sufficiently to pass fairly rigid industry standards.

Therefore, what is needed is a perforation gun which, upon firing, does not fracture prematurely and does not leave a relatively large amount of debris in the well after the explosions. Also needed is a gun of this type in which the mounting plate is provided with sufficient surface to receive the charge units in a manner to insure that the caps of the charge units will not separate from the mounting strip during the operation. In addition, a gun of this type is needed in which the case of the charge unit is firmly secured to the cap.

SUMMARY OF THE INVENTION

The present invention is thus directed to a perforation gun for a well casing in which a plurality of explosive charge units are mounted on an elongated mounting strip in a pattern corresponding to the desired pattern of perforations in the well casing. The areas of the mounting strip that receive the charge units have a greater width than the remaining areas of the strip to provide an increased support surface for the charge units. As a result, the mounting strip is provided with sufficient surface area to receive the charge units in a manner to insure that the caps of the charge units will not separate from the mounting strip during the operation. Also, the mounting strip will not fracture during the operation. Each charge unit is formed by a case connected to a cap to provide a housing for the explosive. The cap is crimped to the case to prevent premature detonation of the explosive.

DESCRIPTION OF THE PREFERRED EMBODIMENT

Figure 1:
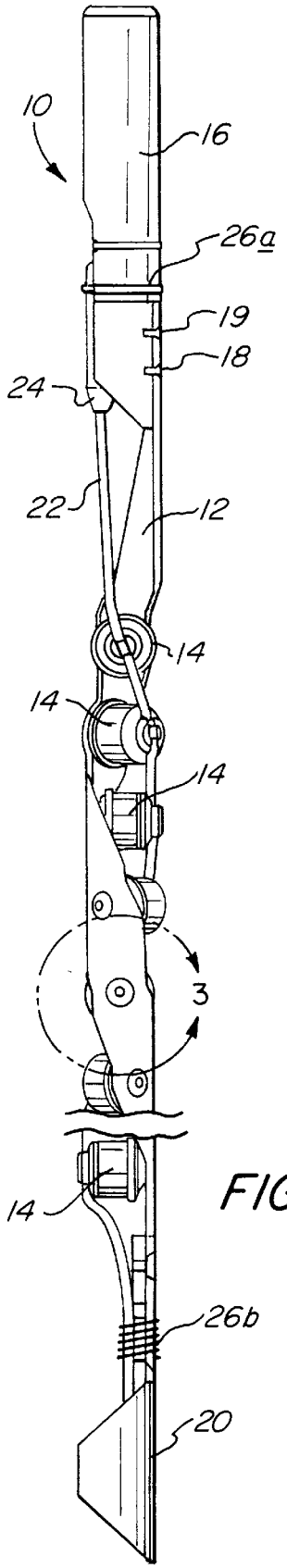
FIG. 1 is an isometric view of the perforation gun of the present invention.

Referring to FIG. 1 of the drawing, the reference numeral 10 refers in general to the perforation gun of the present invention which is positioned for insertion into a well casing (not shown), or the like, to form perforations in the casing through which water, petroleum or minerals can flow. The gun 10 includes an elongated mounting strip 12 formed into a spiral in any conventional manner. For example, the strip 12 can be formed from drawn-over-mandrel steel tubing by a multiple axes milling machine. The milling machine would be rotatable in order to slit the entire length of the tube in a manner so that four separate spiral strips are manufactured from each tube.

A series of axially and angularly spaced openings are machined through the strip 12 for mounting a plurality of capsule explosive charge units 14 to the strip in a manner to be described. These openings are spaced in intervals along the length of the spiral strip so that they are arranged in a phase relationship to correspond with the selected perforation pattern in the well. The angular spacing is such that the charge units 14 are in a phased relationship between 0 and 360 degrees, and for the purposes of example, the charge units 14 can be angularly spaced 45 or 60 degrees. Only a portion of the strip 10 is shown in FIG. 1 for the convenience of presentation it being understood that the strip can be several feet in length and contain four to six charges per foot. Also, it is understood that an additional strip (not shown) can be connected to the lower end of the strip 12 and more additional strips can be added in series as needed.

The upper end of the strip 12 is connected to an upper sub 16, as viewed in FIG. 1, the upper end portion of which is internally threaded to enable it to be connected to a wire assembly (not shown) in a conventional matter. A plurality of set screws 18, two of which are shown in FIG. 1, extend through openings in the upper end portion of the strip 12 and into aligned threaded bores in the sub 16 to fasten the strip to the sub. As a result, the sub 16 can be raised or lowered to position the gun 10 at a selected elevation in the well adjacent to that portion of the well casing to be perforated.

A lower sub 20 is connected to the lower end portion of the mounting strip 12. Although not shown in the drawings, it is understood that the lower sub 20 is secured to the mounting strip 12 in the same manner as described above in connection with the upper sub 16; that is, by providing a plurality of set screws that extend through openings in the lower end portion of the strip and into aligned threaded bores in the lower sub.

A detonator cord 22 extends from the lower end portion of the upper sub 16 and winds around the strip 12. The cord is connected to each of the charge units 14 in a manner to be described, and extends to the lower sub 20. The upper end of the cord 22 is connected to a detonator 24 which is secured to the upper sub 16 by a nylon cord 26*a*. Another nylon cord 26*b* secures the lower end portion of the detonator cord 22 to the lower sub 20.

It is understood that the detonator 24 is electrically connected in a electrical circuit, including conductors (not shown) that extend from above ground, through the upper sub 16 and are connected to the detonator. Thus, electrical energy can be supplied to the detonator 24 to ignite the cord 22 and sequentially detonate the charge units 14. Since the detonator cord 22, the detonator 24, and the manner in which they detonate the charge units 14 are conventional they will not be described in any further detail.

Figure 2:
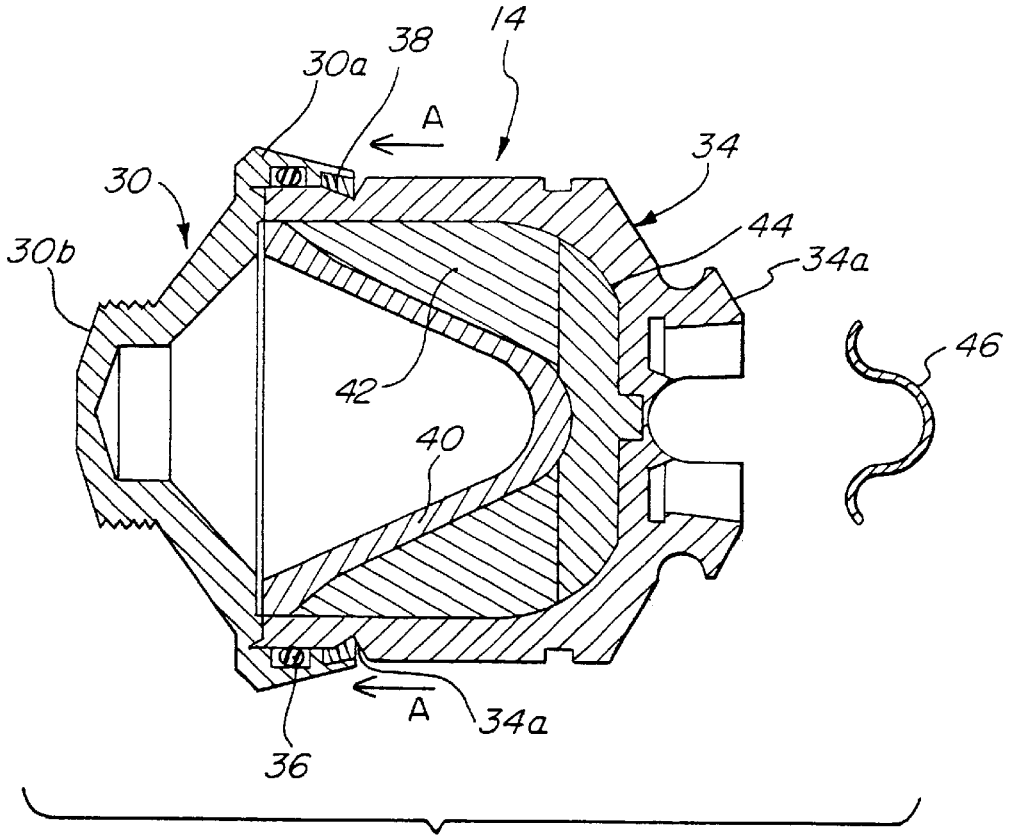
FIG. 2 is a cross-section view of a charge unit of the gun of FIG. 1.

A charge unit 14 is shown in detail in FIG. 2 and includes a frustroconical cap 30 having a rim 30*a* formed at an open end portion that defines a cylindrical inner surface and a beveled outer surface. An externally threaded boss 30*b* is formed at the base of the cap 30 for threadedly engaging one of the above-mentioned internally threaded openings in the strip 12.

A hollow case 34 is provided and is connected to the cap 30 according to a feature of the present invention. More particularly, the rim 30*a* of the cap 30 extends around, and is crimped to, the corresponding end portion of the case 34. To this end, an O-ring 36 extends in a corresponding groove formed in the interior surface of the rim 30*a* and engages a corresponding outer surface of the case 34. A crimp ring 38 extends in the end portion of the interior surface of the rim 30*a* and rests against an annular shoulder formed by the interior surface of the rim. An annular groove 34*a* is formed in the outer surface of the case 34 that receives the crimp ring 38 and the corresponding portion of the rim 30*a*.

To attach the case 34 to the cap 30 a crimping tool (not shown) is provided which exerts an external force against the beveled surface of the rim 30*a* in the direction shown by the arrows A in FIG. 2. This action crimps, or cams, the rim 30*a* radially inwardly into the groove 34*a* of the case 34 with a substantial force, with the crimp ring 38 extending between the crimped rim portion and that portion of the case forming the groove.

A liner 40 is disposed in the interior of the case 34 and defines a compartment that contains an explosive 42 and a primer 44. A boss 34*a* is provided on the base of the case 34 and is notched to receive a segment of the detonator cord 22 (not shown in FIG. 2). A clip 46, shown spaced from the boss 34*a* in FIG. 2, is provided that extends around the cord 22 and engages in the boss 34*a* in tension to retain the cord in the boss and thus locate the cord immediately adjacent the primer.

Figure 3:
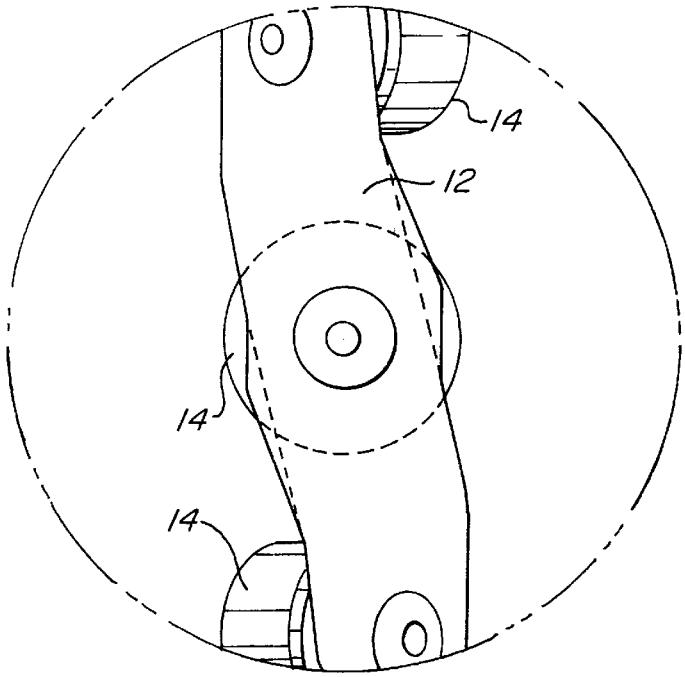
FIG. 3 is an enlarged view of a portion of the gun of FIG. 1.

Another feature of the present invention is better shown in FIG. 3. More particularly, the width of the mounting strip 12 at the areas of the strip that receive the charge units 14 is increased slightly so as to provide added support for the charge units. This increased width is shown in FIG. 3, with the normal width of the strip 12 being shown by the phantom straight lines. In this manner, the caps 30 have a much better chance of being retained in the strip 12 after the explosion of the charge units 14 and thus can be retrieved from the well casing.

In operation, the detonator 24 is activated by the electrical circuit described above and functions to ignite the detonator cord 22 starting with its upper end and continuing for its entire length. As the ignition of the segments of the cord 22 respectively associated with the charge units 14 occurs, the explosive in the latter units are detonated causing the explosive to explode. Thus, the charge units 14 are sequentially detonated until the lowermost charge unit is detonated and the operation is complete. The explosions are sufficient to perforate the well casing in a pattern corresponding to the mounting pattern of the charge units 14 on the strip 12.

Several advantages result from the foregoing. For example, the added width of the mounting strip 12 at the location of the charge units 14 provides sufficient surface to receive the charge units in a manner to insure that the caps 30 of the charge units will not separate from the mounting strip during the operation and form debris in the well. Also, the mounting strip 12 can be manufactured from steel stock and therefore does not fracture doing the operation and thus form debris. Further, the cases 34 of the charge units 14 are firmly secured to their respective caps 30 so that the charge units will not explode prematurely. Also, the effective diameter of the gun 10 is small enough so that it can easily be inserted in, and removed from, the well casing.

It is understood that several variations can be made in the foregoing without departing from the scope of the invention. For example, the particular number and location of the charge units 14 on the strip 12 can be varied within the scope of the invention. Also, the particular technique of detonating the charge units 14 can be varied within the scope of the invention. Further, open end portion of the case 34 can be crimped over the corresponding end portion of the cap 30.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A perforating gun for perforating a section of a well casing, the perforating gun comprising:

elongated spiral mounting strip comprising a plurality of charge receiving areas, the charge receiving areas being separated from each other by intervening remaining areas of the strip, and a plurality of explosive charge units mounted on the strip at the charge receiving areas, the charge receiving areas of the strip having a greater width than the intervening remaining areas of the strip to provide an increased support surface for the charge units.

2. The perforating gun of claim 1 wherein the charge units are disposed in an axially-spaced and an angularly-spaced relation along the strip.

3. The perforating gun of claim 1 wherein a plurality of threaded openings are formed through the strip; and wherein each charge unit comprises a housing for containing an explosive, and a threaded boss formed on the housing for threadedly engaging in a corresponding opening in the strip to mount the charge unit on the strip.

4. The perforating gun of claim 3 wherein the housing comprises a case for containing the explosive and a cap on which the threaded boss is formed, the cap being crimped around an end portion of the case to secure the case to the cap.

5. The perforating gun of claim 1 further comprising a detonator cord wound around the strip and connected to the charge units for detonating the explosives in the charge units, and means for igniting the detonator cord.

6. The perforating gun of claim 5 wherein each charge unit comprises a housing for containing an explosive and a notched boss formed on the housing for receiving the detonator cord.

* * * * *